US008330699B2

(12) United States Patent
Hong et al.

(10) Patent No.: US 8,330,699 B2
(45) **Date of Patent: *Dec. 11, 2012**

(54) LIQUID CRYSTAL DISPLAY AND METHOD OF DRIVING THE SAME

(75) Inventors: Jincheol Hong, Paju-si (KR); Pilsung Kang, Paju-si (KR); Yangseok Jeong, Goyang-si (KR); Jinho Choi, Seoul (KR); Minho Lee, Seoul (KR); Sunghyun Yang, Seoul (KR)

(73) Assignee: LG Display Co. Ltd, Seoul (KR)

( * ) Notice: Subject to any disclaimer, the term of this patent is extended or adjusted under 35 U.S.C. 154(b) by 654 days.

This patent is subject to a terminal disclaimer.

(21) Appl. No.: 12/543,996

(22) Filed: Aug. 19, 2009

(65) Prior Publication Data

US 2010/0148829 A1 Jun. 17, 2010

(30) Foreign Application Priority Data

Dec. 15, 2008 (KR) ..... 10-2008-0127458

(51) Int. Cl.
*G09G 3/36* (2006.01)

(52) U.S. Cl. ..... 345/99; 345/100

(58) Field of Classification Search ..... 345/87–104, 345/204–215, 690–699

See application file for complete search history.

(56) References Cited

U.S. PATENT DOCUMENTS

| | | | | |
|---|---|---|---|---|
| 6,771,281 | B2 * | 8/2004 | Takagi | 345/690 |
| 6,954,201 | B1 * | 10/2005 | Ludden et al. | 345/204 |
| 7,898,518 | B2 * | 3/2011 | Hong et al. | 345/99 |
| 7,936,330 | B2 * | 5/2011 | Park et al. | 345/99 |
| 7,948,465 | B2 * | 5/2011 | Cho et al. | 345/99 |
| 8,223,103 | B2 * | 7/2012 | Kim et al. | 345/94 |
| 2004/0227716 | A1 * | 11/2004 | Lin | 345/99 |
| 2008/0036957 | A1 * | 2/2008 | Hsu et al. | 349/151 |
| 2008/0291181 | A1 * | 11/2008 | Nam et al. | 345/204 |
| 2010/0149082 | A1 * | 6/2010 | Hong et al. | 345/88 |
| 2010/0149083 | A1 * | 6/2010 | Park et al. | 345/99 |
| 2010/0156879 | A1 * | 6/2010 | Hong et al. | 345/213 |
| 2010/0156885 | A1 * | 6/2010 | Cho et al. | 345/214 |

* cited by examiner

*Primary Examiner* — Alexander Eisen
*Assistant Examiner* — Patrick F Marinelli
(74) *Attorney, Agent, or Firm* — Brinks Hofer Gilson & Lione

(57) ABSTRACT

A liquid crystal display and a method of driving the same are disclosed. The liquid crystal display includes a timing controller, N source drive integrated circuits (ICs), where N is an integer equal to or greater than 2, N pairs of data bus lines, each of which connects the timing controller to each of the N source drive ICs in a point-to-point manner, a lock check line that connects a first source drive IC of the N source drive ICs to the timing controller and cascade-connects the N source drive ICs to one another, a feedback check line that connects a last source drive IC of the N source drive ICs to the timing controller.

20 Claims, 16 Drawing Sheets

LIQUID CRYSTAL DISPLAY AND METHOD OF DRIVING THE SAME

RELATED APPLICATIONS

This application claims the benefit of Korea Patent Application No. 10-2008-0127458 filed on Dec. 15, 2008, the entire contents of which is incorporated herein by reference for all purposes as if fully set forth herein.

BACKGROUND

1. Field of the Invention

The embodiments disclosed herein relate to a liquid crystal display and a method of driving the same.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of an active matrix type liquid crystal displays. Accordingly, cathode ray tubes (CRT) are being rapidly replaced by the active matrix type liquid crystal displays.

A liquid crystal display includes a plurality of source drive integrated circuits (ICs) supplying a data voltage to data lines of a liquid crystal display panel, a plurality of gate drive ICs sequentially supplying a gate pulse (i.e., a scan pulse) to gate lines of the liquid crystal display panel, and a timing controller controlling the source drive ICs and the gate drive ICs. In the liquid crystal display, digital video data is input to the timing controller through an interface. The timing controller supplies the digital video data, a clock for sampling the digital video data, a control signal for controlling an operation of the source drive ICs, and the like to the source drive ICs through an interface such as a mini low-voltage differential signaling (LVDS) interface. The source drive ICs deserializes the digital video data serially input from the timing controller to output parallel data and then converts the parallel data into an analog data voltage using a gamma compensation voltage to supply the analog data voltage to the data lines.

The timing controller supplies necessary signals to the source drive ICs using a multi-drop manner of commonly applying the clock and the digital video data to the source drive ICs. Because the source drive ICs are cascade-connected to one another, the source drive ICs sequentially sample the digital video data and then simultaneously output data voltages corresponding to 1 line. In such a data transfer method, many lines such as R, G, and B data transfer lines and clock transfer lines are necessary between the timing controller and the source drive ICs. Because the mini LVDS interface is a manner of transferring each of the digital video data and the clock in the form of a pair of differential signals, which are out of phase with each other, at least 14 data transfer lines between the timing controller and the source drive ICs are necessary to simultaneously transfer odd data and even data. Accordingly, because many data transfer lines have to be formed on a printed circuit board (PCB) positioned between the timing controller and the source drive ICs, it is difficult to reduce the number of data transfer lines.

BRIEF SUMMARY

In one aspect, there is a liquid crystal display comprising a timing controller, N source drive integrated circuits (ICs), where N is an integer equal to or greater than 2, N pairs of data bus lines, each of which connects the timing controller to each of the N source drive ICs in a point-to-point manner, a lock check line that connects a first source drive IC of the N source drive ICs to the timing controller and cascade-connects the N source drive ICs to one another, and a feedback lock check line that connects a last source drive IC of the N source drive ICs to the timing controller.

The timing controller serially transfers a preamble signal, in which a plurality of bits having a high logic level are successively arranged and then a plurality of bits having a low logic level are successively arranged, to each of the N source drive ICs through each of the N pairs of data bus lines, transfers a lock signal indicating that a phase of an internal clock pulse output from each of the N source drive ICs is locked to the first source drive IC through the lock check line, and receives a feedback signal of the lock signal from the last source drive IC through the feedback lock check line.

In another aspect, there is a method of driving a liquid crystal display including a timing controller and N source drive integrated circuits (ICs), where N is an integer equal to or greater than 2, the method comprising generating a preamble signal, in which a plurality of bits having a high logic level are successively arranged and then a plurality of bits having a low logic level are successively arranged, from the timing controller, serially transferring the preamble signal to each of the N source drive ICs through each of N pairs of data bus lines connecting the timing controller to the N source drive ICs in a point-to-point manner, generating a lock signal indicating that a phase of an internal clock pulse output from each of the N source drive ICs is locked from the timing controller, transferring the lock signal to a first source drive IC of the N source drive ICs through a lock check line that connects the first source drive IC to the timing controller and cascade-connects the N source drive ICs to one another, generating a feedback signal of the lock signal from a last source drive IC of the N source drive ICs, and transferring the feedback signal of the lock signal to the timing controller through a feedback lock check line connecting the last source drive IC to the timing controller.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Reference will now be made in detail embodiments of the invention examples of which are illustrated in the accompanying drawings.

Figure 1:
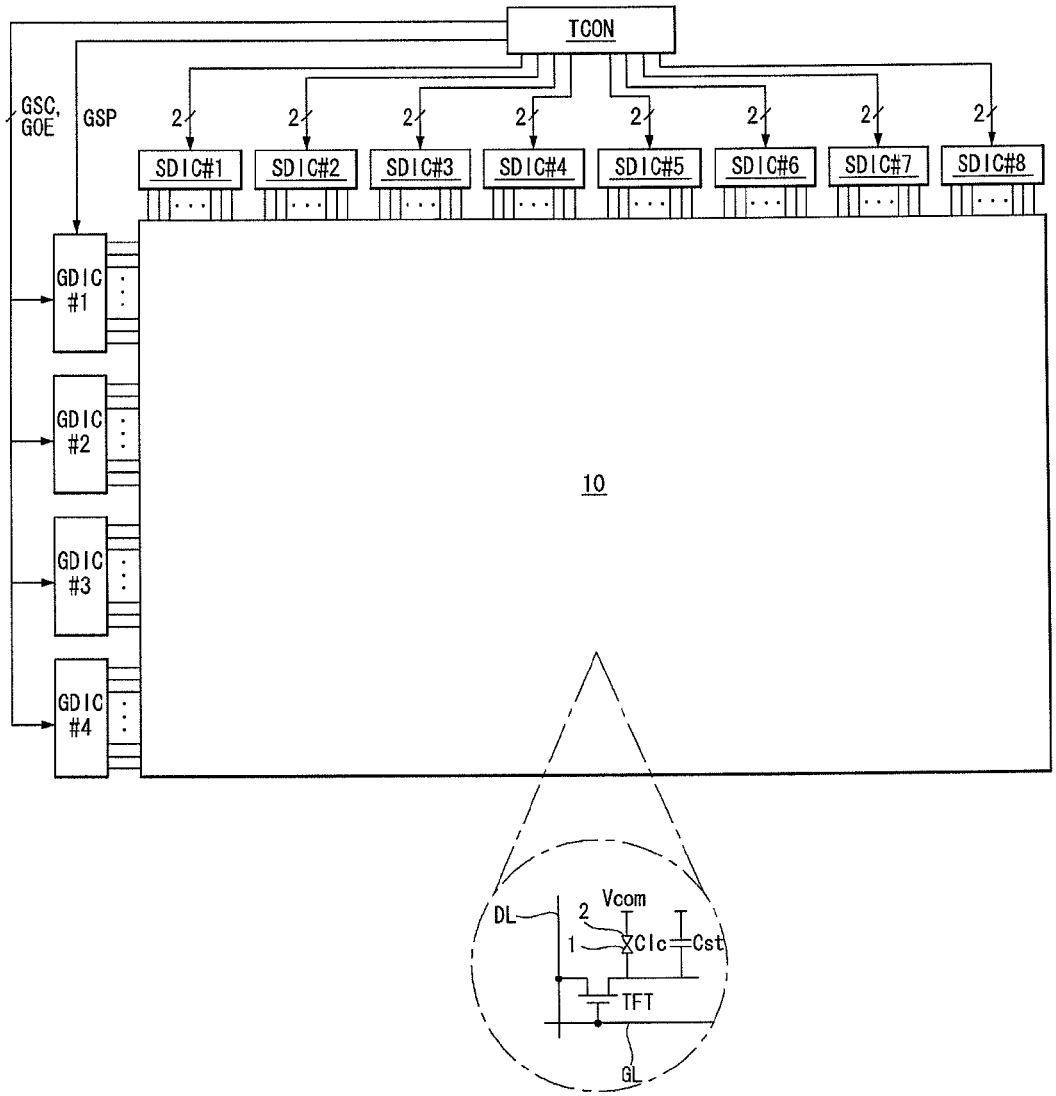
FIG. 1 is a block diagram illustrating a liquid crystal display according to an embodiment of the disclosure.

As shown in FIG. 1, a liquid crystal display according to an embodiment of the invention includes a liquid crystal display panel 10, a timing controller TCON, a plurality of source drive integrated circuits (ICs) SDIC#1 to SDIC#8, and a plurality of gate drive ICs GDIC#1 to GDIC#4.

The liquid crystal display panel 10 includes an upper glass substrate, a lower glass substrate, and a liquid crystal layer between the upper and lower glass substrates. The liquid crystal display panel 10 includes m×n liquid crystal cells CIc arranged at each of crossings of m data lines DL and n gate lines GL in a matrix format.

A pixel array including the data lines DL, the gate lines GL, thin film transistors (TFTs), a storage capacitor Cst, etc. is formed on the lower glass substrate of the liquid crystal display panel 10. Each of the liquid crystal cells CIc is driven by an electric field between a pixel electrode 1 receiving a data voltage through the TFT and a common electrode 2 receiving a common voltage Vcom. In each of the TFTs, a gate electrode is connected to the gate line GL, a source electrode is connected to the data line DL, and a drain electrode is connected to the pixel electrode 1 of the liquid crystal cell CIc. The TFT is turned on when a gate pulse is supplied through the gate line GL, and thus supplies a positive or negative analog video data voltage received through the data line DL to the pixel electrode 1 of the liquid crystal cell CIc.

A black matrix, a color filter, the common electrode 2, etc, are formed on the upper glass substrate of the liquid crystal display panel 10.

The common electrode 2 is formed on the upper glass substrate in a vertical electric drive manner, such as a twisted nematic (TN) mode and a vertical alignment (VA) mode. The common electrode 2 and the pixel electrode 1 are formed on the lower glass substrate in a horizontal electric drive manner, such as an in-plane switching (IPS) mode and a fringe field switching (FFS) mode.

Polarizing plates are respectively attached to the upper and lower glass substrates of the liquid crystal display panel 10. Alignment layers for setting a pre-tilt angle are respectively formed on the upper and lower glass substrates. A spacer is formed between the upper and lower glass substrates to keep cell gaps of the liquid crystal cells CIc constant.

The liquid crystal display according to the embodiment of the invention may be embodied in any liquid crystal mode as well as the TN, VA, IPS, and FFS modes. Further, the liquid crystal display according to the embodiment of the invention may be implemented as any type liquid crystal display including a backlit liquid crystal display, a transflective liquid crystal display, and a reflective liquid crystal display.

The timing controller TCON is connected to the source drive ICs SDIC#1 to SDIC#8 in a point-to-point manner. The timing controller TCON transfers a preamble signal for initializing the source drive ICs SDIC#1 to SDIC#8, a clock, RGB digital video data, etc. to each of the source drive ICs SDIC#1 to SDIC#8 through each of a plurality of pairs of data bus lines.

The timing controller TCON receives an external timing signal such as, vertical and horizontal sync signals Vsync and Hsync, an external data enable signal DE, and a dot clock CLK through an interface, such as a low voltage differential signaling (LVDS) interface and a transition minimized differential signaling (TMDS) interface to generate timing control signals for controlling operation timings of the source drive ICs SDIC#1 to SDIC#8 and operation timings of the gate drive ICs GDIC#1 to GDIC#4. The timing control signals include a gate timing control signal and a data timing control signal.

The gate timing control signal includes a gate start pulse GSP, a gate shift clock GSC, a gate output enable signal GOE, and the like. The gate start pulse GSP is applied to the first gate drive IC GDIC#1 to thereby indicate scan start time of a scan operation so that the first gate drive IC GDIC#1 generates a first gate pulse. The gate shift clock GSC is a clock for shifting the gate start pulse GSP. A shift register of each of the gate drive ICs GDIC#1 to GDIC#4 shifts the gate start pulse GSP at a rising edge of the gate shift clock GSC. The second to fourth gate drive ICs GDIC#2 to GDIC#4 receive a carry signal of the first gate drive IC GDIC#1 as a gate start pulse to start operating. The gate output enable signal GOE controls output timings of the gate drive ICs GDIC#1 to GDIC#4. The gate drive ICs GDIC#1 to GDIC#4 output a gate pulse in a low logic level state of the gate output enable signal GOE, i.e., during a period of time ranging from immediately after a falling edge of a current pulse to immediately before a rising edge of a next pulse. 1 cycle of the gate output enable signal GOE is about 1 horizontal period.

The data timing control signal includes a polarity control signal POL, a source output enable signal SOE, and the like. The polarity control signal POL controls a polarity of the positive/negative analog video data voltage output from the source drive ICs SDIC#1 to SDIC#8. The source output enable signal SOE controls an output timing of the positive/negative analog video data voltage from the source drive ICs SDIC#1 to SDIC#8.

Each of the gate drive ICs GDIC#1 to GDIC#4 sequentially supplies the gate pulse to the gate lines GL in response to the gate timing control signal.

Each of the source drive ICs SDIC#1 to SDIC#8 locks a frequency and a phase of an internal clock pulse output from a clock separation and data sampling unit embedded inside each of the source drive ICs SDIC#1 to SDIC#8 in response to the preamble signal transferred by the timing controller TCON through the pair of data bus lines. Then, each of the source drive ICs SDIC#1 to SDIC#8 separates a clock from an RGB data packet supplied through the pair of data bus lines to generate a serial clock for data sampling and samples the RGB digital video data serially input in response to the serial clock. Subsequently, each of the source drive ICs SDIC#1 to SDIC#8 deserialize the sequentially sampled RGB digital video data to output parallel data, and then convert the parallel data into the positive/negative analog video data voltage to supply the positive/negative analog video data voltage to the data lines DL.

Figure 2:
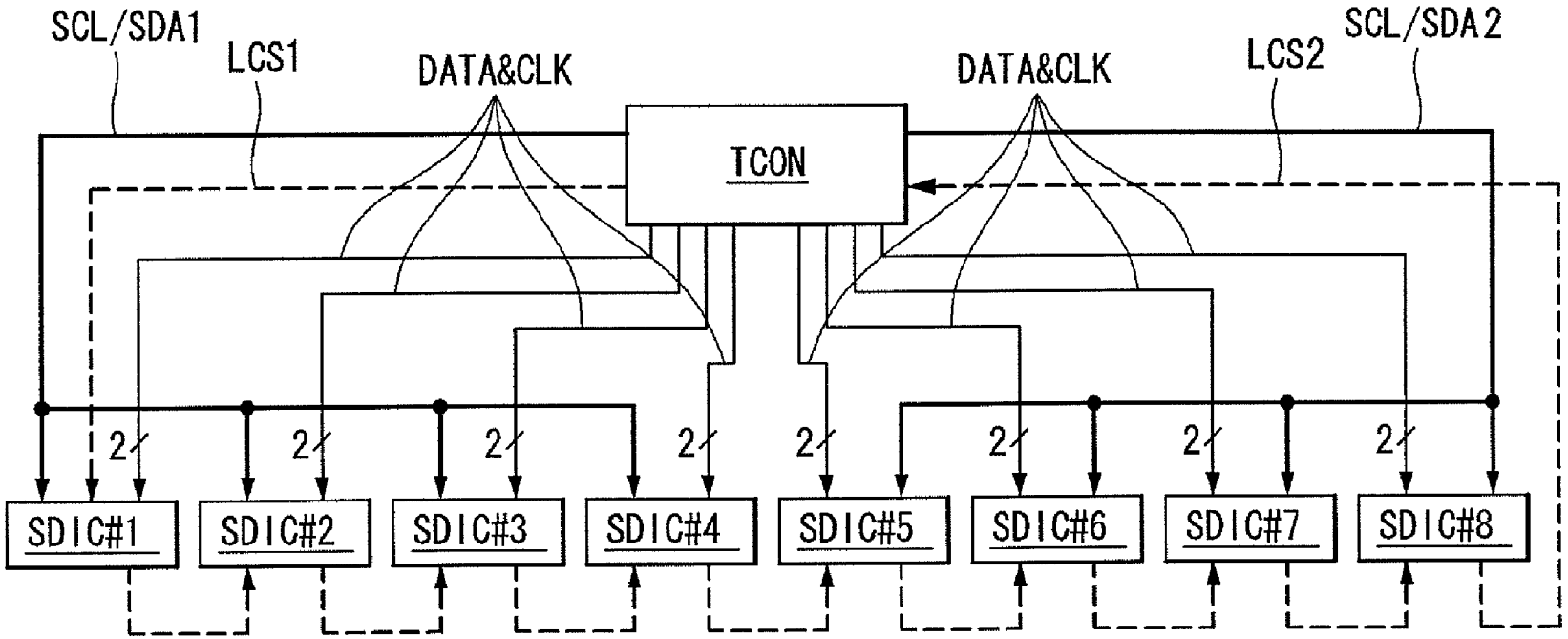
FIG. 2 illustrates lines between a timing controller and source drive integrated circuits (ICs)

FIG. 2 illustrates lines between the timing controller TCON and the source drive ICs SDIC#1 to SDIC#8.

As shown in FIG. 2, a plurality of pairs of data bus lines DATA&CLK, first and second pairs of control lines SCL/SDA1 and SCL/SDA2, lock check lines LCS1 and LCS2, etc. are formed between the timing controller TCON and the source drive ICs SDIC#1 to SDIC#8. Lines (not shown) for transferring the polarity control signal POL and the source output enable signal SOE are formed between the timing controller TCON and the source drive ICs SDIC#1 to SDIC#8.

The timing controller TCON transfers a bit steam including the preamble signal, the clock, and the RGB data to each of the source drive ICs SDIC#1 to SDIC#8 through each of the pairs of data bus lines DATA&CLK. Each of the pairs of data bus lines DATA&CLK connect in series the timing controller TCON to each of the source drive ICs SDIC#1 to SDIC#8. Namely, the timing controller TCON is connected to the source drive ICs SDIC#1 to SDIC#8 in the point-to-point manner. Each of the source drive ICs SDIC#1 to SDIC#8 restores clocks input through the pair of data bus lines DATA&CLK. Accordingly, lines for transferring a clock carry and the RGB video data are not necessary between the adjacent source drive ICs SDIC#1 to SDIC#8.

Figure 8:
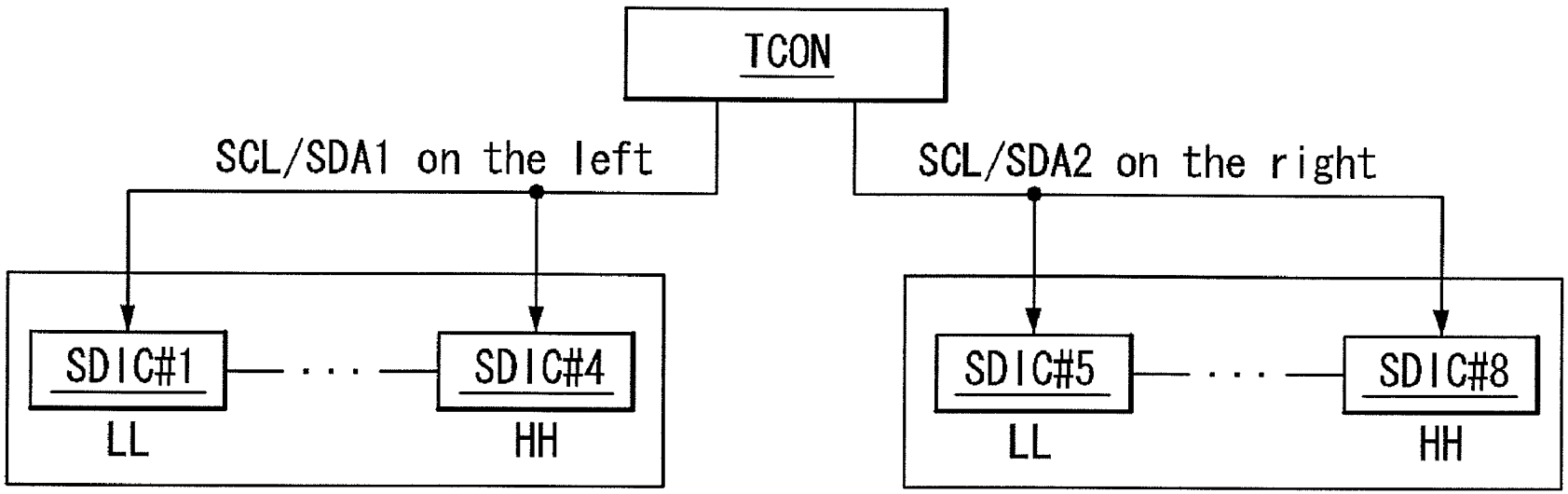
FIG. 8 illustrates an example of a serial communication control path and a chip identification code capable of allowing source drive ICs to perform a debugging operation.

The timing controller TCON transfers a chip identification code CID of each of the source drive ICs SDIC#1 to SDIC#8 and control data for controlling functions of each of the source drive ICs SDIC#1 to SDIC#8 to each of the source drive ICs SDIC#1 to SDIC#8 through the pairs of control lines SCL/SDA1 and SCL/SDA2. The pairs of control lines SCL/SDA1 and SCL/SDA2 are commonly connected between the timing controller TCON and the source drive ICs SDIC#1 to SDIC#8. More specifically, as shown in FIG. 8, if the source drive ICs SDIC#1 to SDIC#8 are divided into two groups and the two groups are respectively connected to printed circuit boards (PCBs) PCB1 and PCB2, the first pair of control lines SCL/SDA1 on the left connect in parallel the timing controller TCON to the first to fourth source drive ICs SDIC#1 to SDIC#4, and the second pair of control lines SCL/SDA2 on the right connect in parallel the timing controller TCON to the fifth to eighth source drive ICs SDIC#5 to SDIC#8.

The timing controller TCON supplies a lock signal LOCK, that confirms whether or not a phase and a frequency of the internal clock pulse output from the clock separation and data sampling unit of each of the source drive ICs SDIC#1 to SDIC#8 is stably locked, to the first source drive IC SDIC#1 through a lock check line LCS1. The source drive ICs SDIC#1 to SDIC#8 are cascade-connected to one another through the lock check line LCS1. If a frequency and a phase of an internal clock pulse output from the first source drive IC SDIC#1 are locked, the first source drive IC SDIC#1 transfers the lock signal LOCK of a high logic level to the second source drive IC SDIC#2. Next, after a frequency and a phase of an internal clock pulse output from the second source drive IC SDIC#2 are locked, the second source drive IC SDIC#2 transfers the lock signal LOCK of a high logic level to the third source drive IC SDIC#3. The above-described locking operation is sequentially performed, and finally, after a frequency and a phase of an internal clock pulse output from the last source drive IC SDIC# are locked, the last source drive IC SDIC#8 feedback-inputs the lock signal LOCK of a high logic level to the timing controller TCON through a feedback lock check line LCS2. Only after the timing controller TCON receives a feedback signal of the lock signal LOCK, the timing controller TCON transfers the RGB data packets to the source drive ICs SDIC#1 to SDIC#8.

Figure 3:
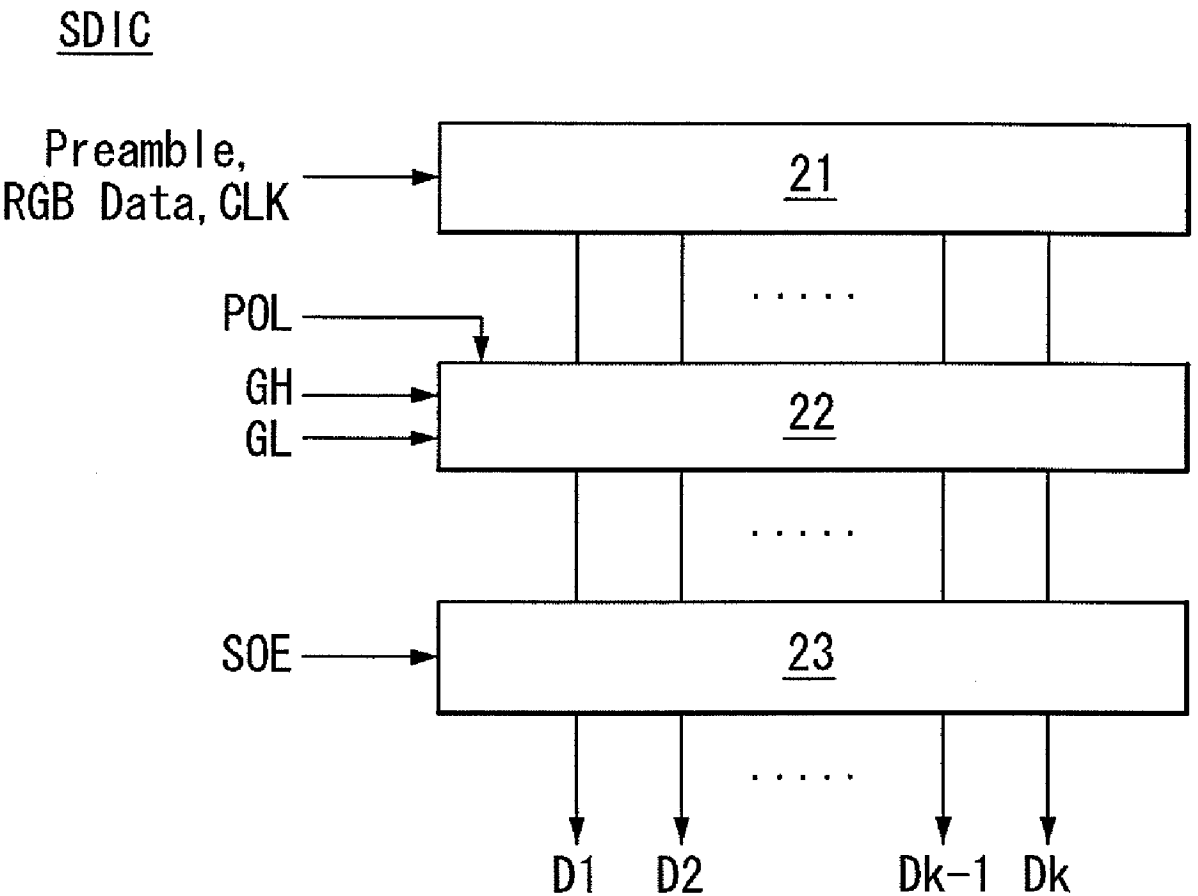
FIG. 3 is a block diagram illustrating a configuration of a source drive IC.

FIG. 3 is a block diagram illustrating a configuration of the source drive ICs SDIC#1 to SDIC#8.

As shown in FIG. 3, each of the source drive ICs SDIC#1 to SDIC#8 supplies the positive/negative analog video data voltage to the k data lines D1 to Dk (where k is a positive integer less than m). Each of the source drive ICs SDIC#1 to SDIC#8 includes a clock separation and data sampling unit 21, a digital-to-analog converter (DAC) 22, an output circuit 23, etc.

In Phase 1, the clock separation and data sampling unit 21 restores the preamble signal, that is input in the form of a pulse row having a low frequency through the pair of data bus lines DATA&CLK, to a reference clock, compares a phase of the reference clock with a phase of an internal clock pulse output from the clock separation and data sampling unit 21, and locks a phase and a frequency of the reference clock and a phase and a frequency of the internal clock pulse. Subsequently, in Phase 2, the clock separation and data sampling unit 21 restores the reference clock from an RGB data packet input through the pair of data bus lines DATA&CLK and outputs internal serial clock pulse signals for sampling each bit of the RGB digital video data in response to the reference clock. For this, the clock separation and data sampling unit 21 includes a phase locked circuit capable of outputting a clock having a stable phase and a stable frequency. Examples of the phase locked circuit include a phase locked loop (PLL) and a delay locked loop (DLL). In the embodiment, an example of using a PLL circuit as the phase locked circuit will be described later. In the embodiment, the clock separation and data sampling unit 21 may include the DLL as well as the PLL.

Figure 7:
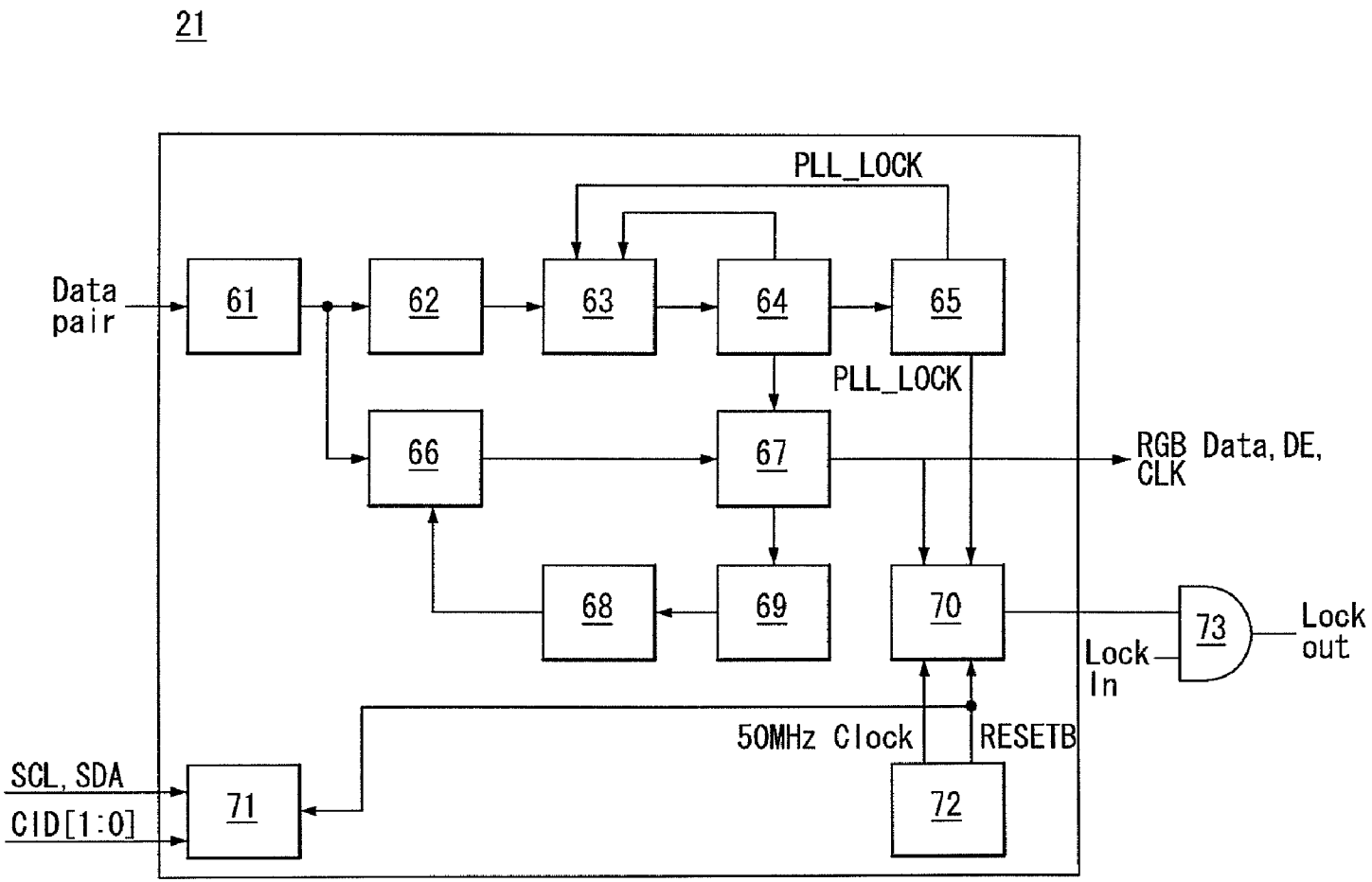
FIG. 7 is a block diagram illustrating a clock separation and data sampling unit.
Figure 9:
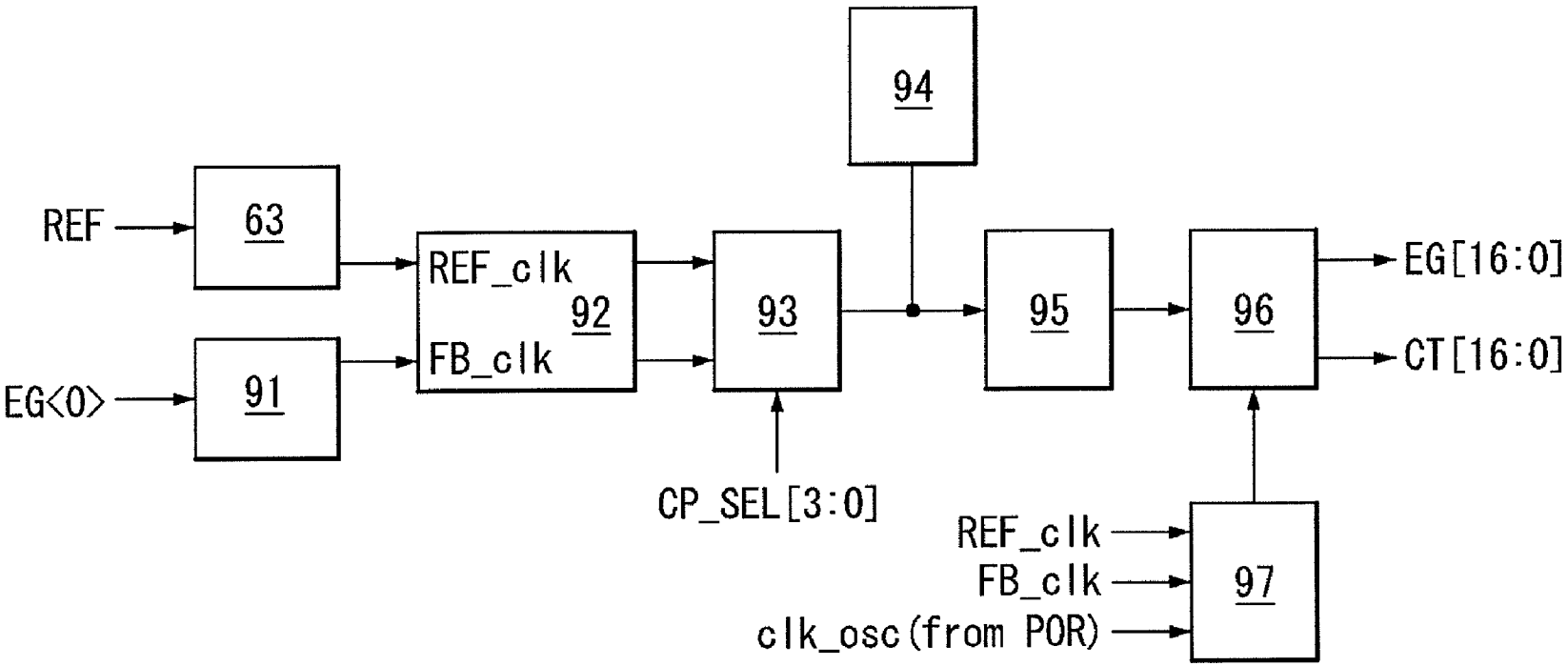
FIG. 9 is a block diagram illustrating a phase locked loop (PLL)

FIGS. 7 to 9 illustrate an example of embodying the clock separation and data sampling unit 21 using the PLL. However, the clock separation and data sampling unit 21 may be embodied using the DLL.

The clock separation and data sampling unit 21 samples and latches each of RGB data bits serially input through the pair of data bus lines DATA&CLK depending on the internal serial clock pulse signal. Then, the clock separation and data sampling unit 21 simultaneously outputs the latched data to convert serial data into parallel data.

The DAC 22 converts the RGB digital video data from the clock separation and data sampling unit 21 into a positive gamma compensation voltage GH or a negative gamma compensation voltage GL in response to the polarity control signal POL and then converts the positive gamma compensation voltage GH or the negative gamma compensation voltage GL into a positive or negative analog video data voltage.

The output circuit 23 supplies a charge share voltage or the common voltage Vcom to the data lines D1 to Dk through an output buffer during a high logic level period of the source output enable signal SOE. The output circuit 23 supplies the positive/negative analog video data voltage to the data lines D1 to Dk through the output buffer during a low logic level period of the source output enable signal SOE. The charge share voltage is generated when the data line receiving the positive analog video data voltage and the data line receiving the negative analog video data voltage are short-circuited. The charge share voltage has an average voltage level between the positive analog video data voltage and the negative analog video data voltage.

Figure 4:
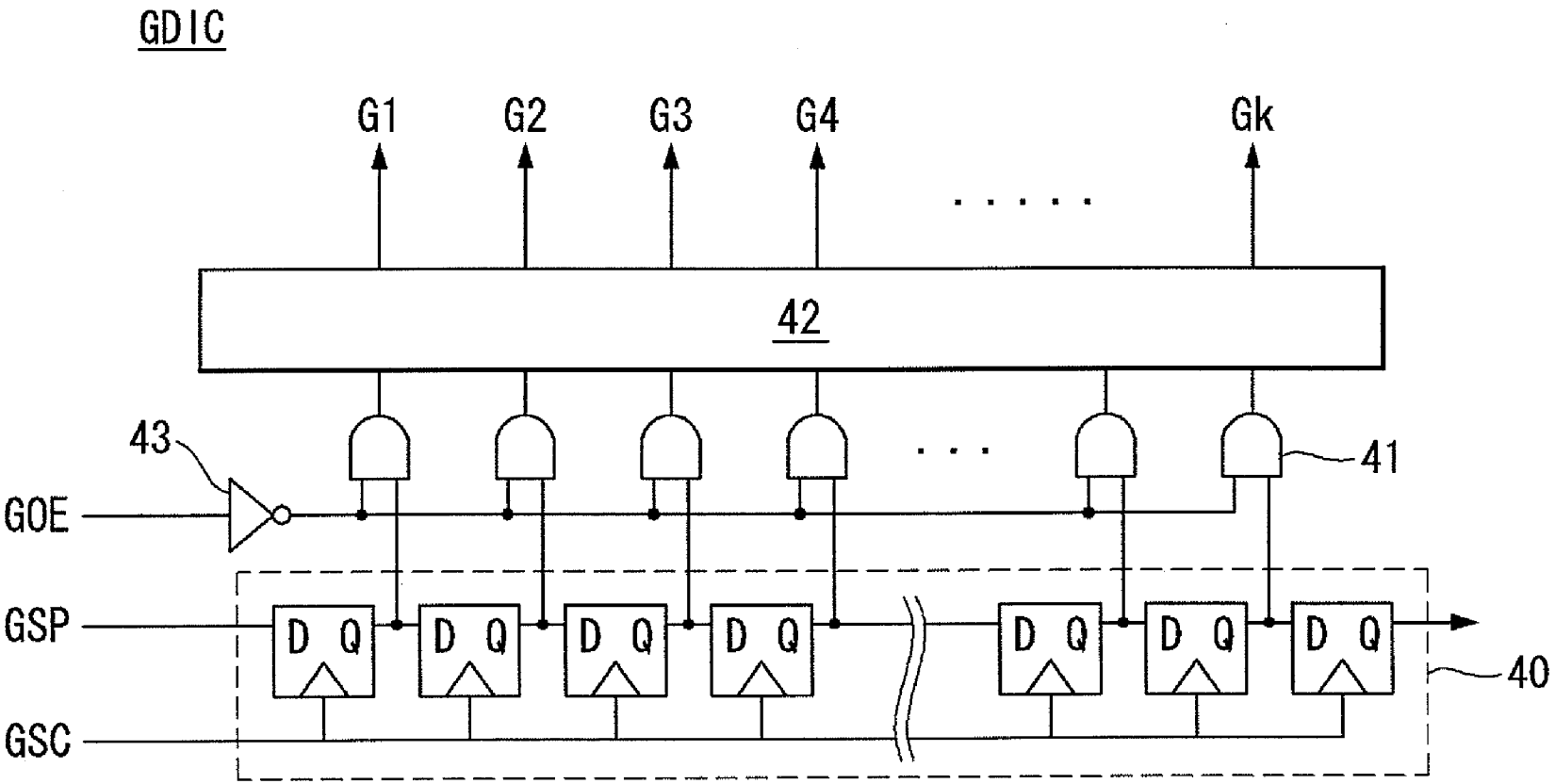
FIG. 4 is a block diagram illustrating a configuration of a gate drive IC.

FIG. 4 is a block diagram illustrating a configuration of the gate drive ICs GDIC#1 to GDIC#4.

As shown in FIG. 4, each of the gate drive ICs GDIC#1 to GDIC#4 includes a shift register 40, a level shifter 42, a plurality of AND gates 41 connected between the shift register 40 and the level shifter 42, and an inverter 43 for inverting the gate output enable signal GOE.

The shift register 40 includes a plurality of cascade connected D flip-flops and sequentially shifts the gate start pulse GSP in response to the gate shift clock GSC using the cascade connected D flip-flops. Each of the AND gates 41 performs an AND operation on an output signal of the shift register 40 and an inversion signal of the gate output enable signal GOE to obtain an output. The inverter 43 inverts the gate output enable signal GOE and supplies the inversion signal of the gate output enable signal GOE to the AND gates 41. Accordingly, each of the gate drive ICs GDIC#1 to GDIC#4 outputs the gate pulse when the gate output enable signal GOE is in a low logic level state.

The level shifter 42 shifts a swing width of an output voltage of the AND gate 41 to a swing width suitable to drive the TFTs in the pixel array of the liquid crystal display panel 10. An output signal of the level shifter 42 is sequentially supplied to the gate lines G1 to Gk.

The shift register 40 together with the TFTs of the pixel array may be directly formed on the glass substrate of the liquid crystal display panel 10. In this case, the level shifter 42 may be formed on not the glass substrate of the liquid crystal display panel 10 but a control board or a source PCB together with the timing controller TCON, a gamma voltage generating circuit, etc.

Figure 5:
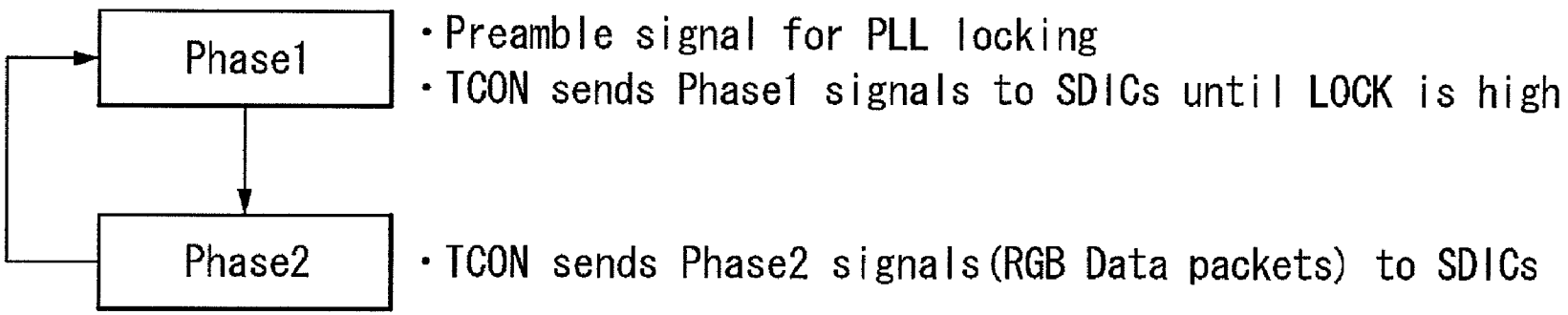
FIGS. 5 and 6 are flow charts illustrating in stages a signal transfer process between a timing controller and source drive ICs.
Figure 6:
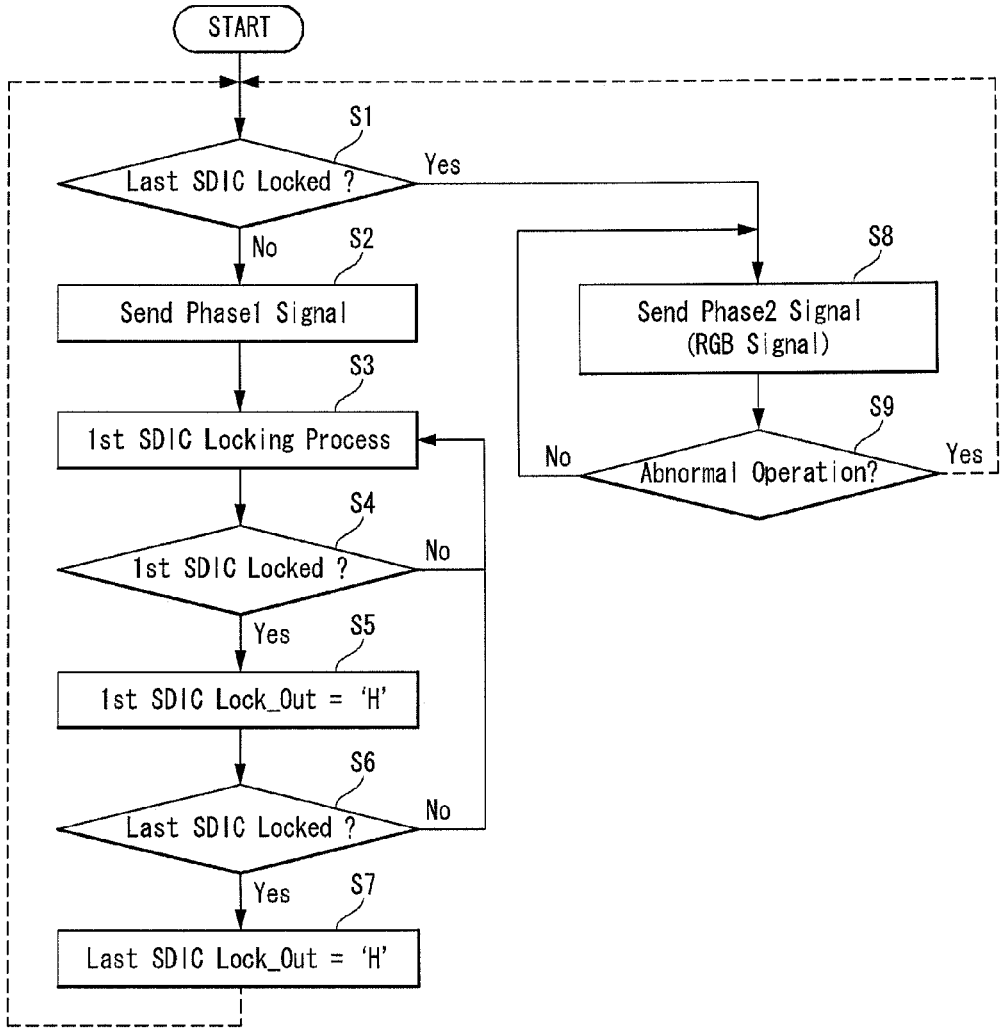

FIGS. 5 and 6 are flow charts illustrating in stages a signal transfer process between the timing controller TCON and the source drive ICs SDIC#1 to SDIC#8.

As shown in FIGS. 5 and 6, if a power is applied to the liquid crystal display, the timing controller TCON supplies Phase 1 signals to each of the source drive ICs SDIC#1 to SDIC#8 through each of the pairs of data bus lines DATA&CLK in steps S1 and S2. The Phase 1 signals include the preamble signal, which is generated in the form of a clock of a low frequency and is supplied to the source drive ICs SDIC#1 to SDIC#8 in the point-to-point manner, and a lock signal supplied to the first source drive IC SDIC#1.

The clock separation and data sampling unit 21 of the first source drive IC SDIC#1 restores the preamble signal to a PLL reference clock and transfers a lock signal of a high logic level to the second source drive IC SDIC#2 when a phase of the PLL reference clock and a phase of an internal clock pulse output from the PLL are locked, in steps S3 to S5. Subsequently, when internal clock pulses output from the clock separation and data sampling units 21 of the second to eighth source drive ICs SDIC#2 to SDIC#8 are sequentially locked stably, the eighth source drive IC SDIC#8 feedback inputs a lock signal of a high logic level to the timing controller TCON in steps S6 and S7.

If the timing controller TCON receives the lock signal of the high logic level from the eighth source drive IC SDIC#8, the timing controller TCON decides that a phase and a frequency of the internal clock pulse output from the clock separation and data sampling unit 21 of each of all the source drive ICs SDIC#1 to SDIC#8 are stably locked. Thus, the timing controller TCON supplies Phase 2 signals to the source drive ICs SDIC#1 to SDIC#8 through the pairs of data bus lines in the point-to-point manner in steps S8 and S9. The Phase 2 signals include a bit stream of the RGB data composed of clock bits that are inserted at regularly spaced intervals.

FIG. 7 is a block diagram illustrating the clock separation and data sampling unit 21 of each of the source drive ICs SDIC#1 to SDIC#8.

As shown in FIG. 7, the clock separation and data sampling unit 21 includes an on-die terminator (ODT) 61, an analog delay replica (ADR) 62, a clock separator 63, a PLL 64, a PLL lock detector 65, a tunable analog delay 66, a deserializer 67, a digital filter 68, a phase detector 69, a lock detector 70, an $I^2C$ controller 71, a power-on reset (POR) 72, and an AND gate 73.

The ODT 61 includes a termination resistor embedded inside the ODT 61 to improve signal integrity by removing a noise mixed in the bit stream including the preamble signal, the RGB data, and the clock received through the pairs of data bus lines DATA&CLK. Further, the ODT 61 includes a receiving buffer and an equalizer embedded inside the ODT 61 to amplify an input differential signal and to convert the amplified differential signal into digital data. The ADR 62 delays the RGB data and the clock received from the ODT 61 by a delay value of the tunable analog delay 66 to make a delay value of a clock path to be equal to a delay value of a data path.

The clock separator 63 separates clock bits from an RGB data packet restored by the ODT 61 to restore the clock bits to a reference clock of the PLL 64. The RGB data packet restored by the ODT 61 includes the clock bits and the RGB digital data, and the clock bits include clock bits, dummy clock bits, internal data enable bits, etc. The PLL 64 generates clocks for sampling the RGB digital video data. If the RGB data packet includes 10-bit RGB data and 4-bit clocks are assigned between the 10-bit RGB data, the PLL 64 generates 34 internal clock pulses per 1 RGB data packet. The PLL lock detector 65 checks a phase and a frequency of each of the internal clock pulses output from the PLL 64 in conformity with a predetermined data rate to detect whether or not the internal clock pulses are locked.

The tunable analog delay 66 is a circuit compensating for a slight phase difference between the RGB data received from the ODT 61 and feedback input restoration clocks via the phase detector 69 and the digital filter 68 so that data can be sampled in the center of the clock. The deserializer 67 includes a plurality of flip-flops embedded inside the deserializer 67 to sample the RGB digital video data bits serially input based on internal clock pulses serially output from the PLL 64 and to convert the sampled data into parallel data.

The digital filter 68 and the phase detector 69 receive the sampled RGB digital video data and determine a delay value of the tunable analog delay 66. The lock detector 70 compares the RGB parallel data restored by the deserializer 67 with an output PLL_LOCK of the PLL lock detector 65 to check an error amount of data enable clocks of the RGB parallel data. If the error amount is equal to or greater than a predetermined value, a physical interface (PHY) circuit entirely operates again by unlocking the internal clock pulses output from the PLL 64. The lock detector 70 generates an output of a low logic level when the internal clock pulses output from the PLL 64 are unlocked. On the other hand, the lock detector 70 generates an output of a high logic level when the internal clock pulses output from the PLL 64 are locked. The AND gate 73 performs an AND operation on a lock signal "Lock In" received from the timing controller TCON or a lock signal "Lock In" transferred by the source drive ICs SDIC#1 to SDIC#7 in previous stage and an output of the lock detector 70. Then, the AND gate 73 outputs a lock signal "Lock Out" of a high logic level when the lock signal "Lock In" and the output of the lock detector 70 are in a high logic level state. The lock signal "Lock Out" of the high logic level is transferred to the source drive ICs SDIC#2 to SDIC#8 in next stage, and the last source drive IC SDIC#8 inputs the lock signal "Lock Out" to the timing controller TCON.

The POR 72 generates a reset signal RESETB for initializing the clock separation and data sampling unit 21 depending on a previously set power sequence and generates a clock of about 50 MHz to supply the clock to digital circuits including the above circuits.

The $I^2C$ controller 71 controls an operation of each of the above circuit blocks using the chip identification code CID input as serial data through the pair of control lines SCL/SDA and control bit. The chip identification codes CID each having a different logic level are respectively given to the source drive ICs SDIC#1 to SDIC#8 as shown in FIG. 8, so that the source drive ICs SDIC#1 to SDIC#8 can be individually controlled. The $I^2C$ controller 71 may perform PLL power down, buffer power down of the ODT 61, EQ On/Off operation of the ODT 61, a control of a charge bump current of the PLL 64, a control of VCO range manual selection of the PLL 64, PLL lock signal push through $I^2C$ communication, an adjustment of an analog delay control value, disable of the lock detector 70, a change in a coefficient of the digital filter 68, a change function in a coefficient of the digital filter 68, physical interface (PHY)_RESETB signal push through $I^2C$, an operation of substituting the lock signal of the previous source drive ICs SDIC#1 to SDIC#7 with a reset signal of the current source drive ICs SDIC#1 to SDIC#8, setting of a vertical resolution of an input image, a storage of a history about data enable clock transition for analyzing a generation cause of the physical interface (PHY)_RESETB signal, etc depending on the chip individual control data input from the timing controller TCON through serial data bus SDA of the pair of control lines SCL/SDA.

FIG. 9 is a block diagram illustrating the PLL 64.

As shown in FIG. 9, the PLL 64 includes a phase comparator 92, a charge pump 93, a loop filter 94, a pulse-to-voltage converter 95, a voltage controlled oscillator (VCO) 96, and a digital controller 97.

The phase comparator 92 compares a phase of a reference clock REF_clk received from the clock separator 63 with a phase of a feedback edge clock FB_clk received from a clock separator replica (CSR) 91. The phase comparator 92 has a pulse width corresponding to a phase difference between the reference clock REF_clk and the feedback edge clock FB_clk as a comparison result. When the phase of the reference clock REF_clk is earlier than the phase of the feedback edge clock FB_clk, the phase comparator 92 outputs a positive pulse. On the other hand, when the phase of the reference clock REF_clk is later than the phase of the feedback edge clock FB_clk, the phase comparator 92 outputs a negative pulse.

The charge pump 93 controls an amount of charges depending on a width and a polarity of an output pulse of the phase comparator 92 to differently supply charges to the loop filter 94. The loop filter 94 accumulates or discharges the charges depending on the amount of charges controlled by the charge pump 93 and removes a high frequency noise including a harmonic component in a clock input to the pulse-to-voltage converter 95.

The pulse-to-voltage converter 95 converts a pulse received from the loop filter 94 into a control voltage of the VCO 96 and controls a level of the control voltage of the VCO 96 depending on a width and a polarity of the pulse received from the loop filter 94. When a bit stream of 1 RGB data packet includes 10-bit RGB data and 4 clock bits, the VCO 96 generates 34 edge clocks and 34 center clocks per the 1 RGB data packet. Further, the VCO 96 controls a phase delay amount of clocks depending on the control voltage from the pulse-to-voltage converter 95 and depending on control data from the digital controller 97.

A first edge clock EG[0] output from the VCO 96 is a feedback edge clock and is input to the clock separator replica 91. The feedback edge clock EG[0] has a frequency corresponding to 1/34 of an output frequency of the VCO 96. The digital controller 97 receives the reference clock REF_clk from the clock separator 63 and the feedback edge clock FB_clk from the clock separator replica 91 and compares a phase of the reference clock REF_clk with a phase of the feedback edge clock FB_clk. Further, the digital controller 97 compares a phase difference obtained as a comparison result with a phase of a 50-MHz clock signal clk_osc from the POR 72. The digital controller 97 controls an output delay amount of the VCO 96 depending on a comparison result of a phase difference to select an oscillation area of the VCO 96.

Figure 10:
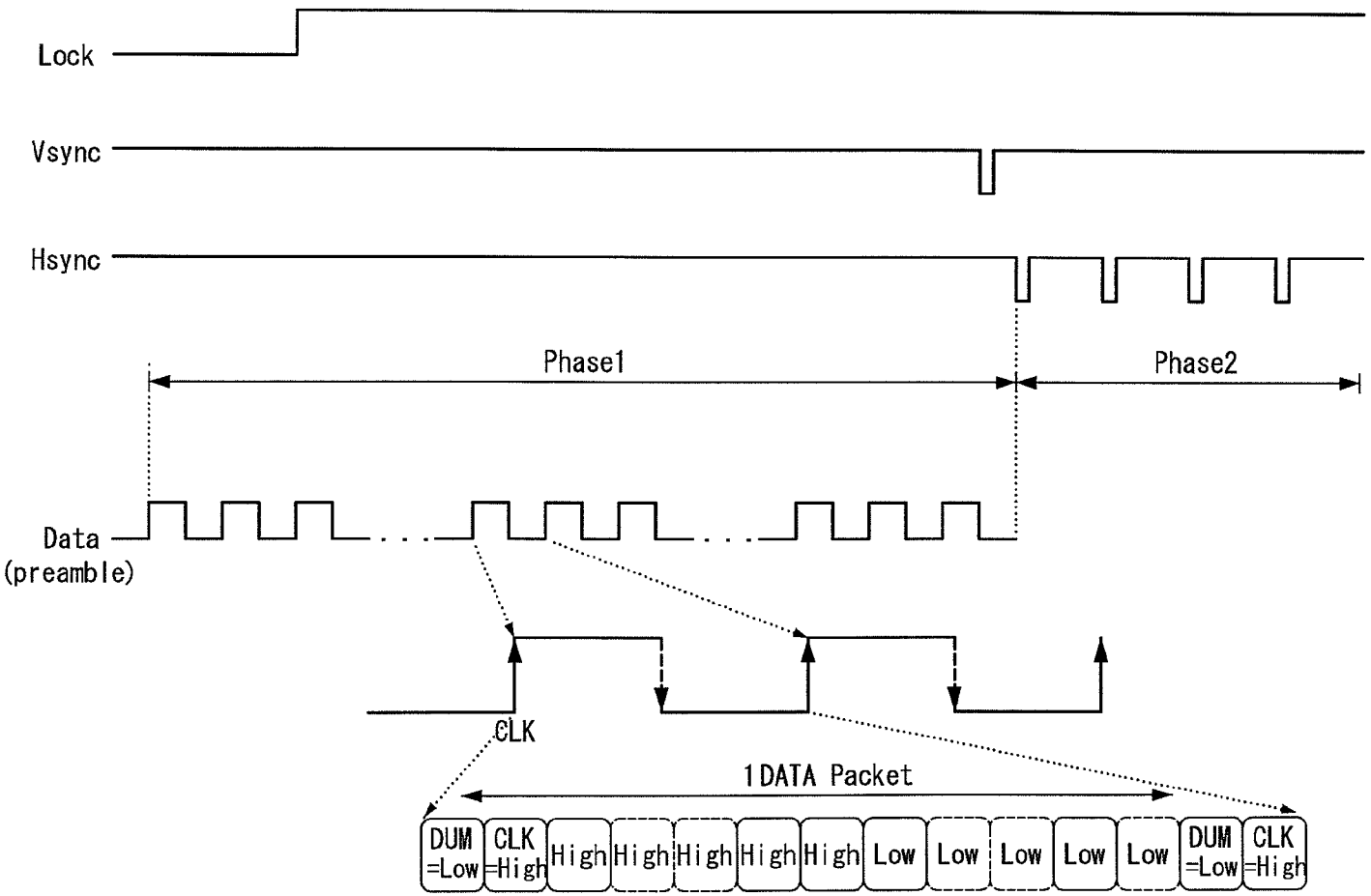
FIG. 10 is a waveform diagram illustrating Phase 1 signals generated by a timing controller.

FIG. 10 is a waveform diagram illustrating signals generated by the timing controller TCON in Phase 1.

As shown in FIG. 10, in Phase 1, the timing controller TCON generates a lock signal and a preamble signal of a low frequency. In the preamble signal of the low frequency, a plurality of bits having a high logic level are successively arranged, and then a plurality of bits having a low logic level are successively arranged. A frequency of the preamble signal corresponds to 1/34 of a frequency of the internal clock pulse output from the PLL 64 of the clock separation and data sampling unit 21 when a bit stream of 1 RGB data packet includes 10-bit RGB data and 4 clock bits. The clock separator 63 of the clock separation and data sampling unit 21 transitions the reference clock REF_clk to a high logic level in synchronization with bits having a high logic level of the preamble signal and transitions the reference clock REF_clk to a low logic level in synchronization with bits having a low logic level of the preamble signal.

The clock separation and data sampling unit 21 of each of the source drive ICs SDIC#1 to SDIC#8 repeatedly performs an operation of comparing the phase of the reference clock REF_clk generated depending on the preamble signal with the phase of the feedback edge clock FB_clk and locking an output. If the output is stably locked, the lock signal is transferred to the source drive ICs SDIC#1 to SDIC#8.

In an initial power-on phase of the liquid crystal display, the timing controller TCON receives the lock signal from the last source drive IC SDIS#8 to confirm a locking of an output of the clock separation and data sampling unit 21. Then, the timing controller TCON outputs the Phase 2 signals during a blanking period of the vertical sync signal Vsync. If an output of the clock separation and data sampling unit 21 is unlocked during a display of video data on the liquid crystal display, the timing controller TCON receives the lock signal from the last source drive IC SDIS#8 to confirm a locking of an output of the clock separation and data sampling unit 21. Then, the timing controller TCON outputs the Phase 2 signals during a first blanking period of the vertical sync signal Vsync and the horizontal sync signal Hync.

Figure 11:
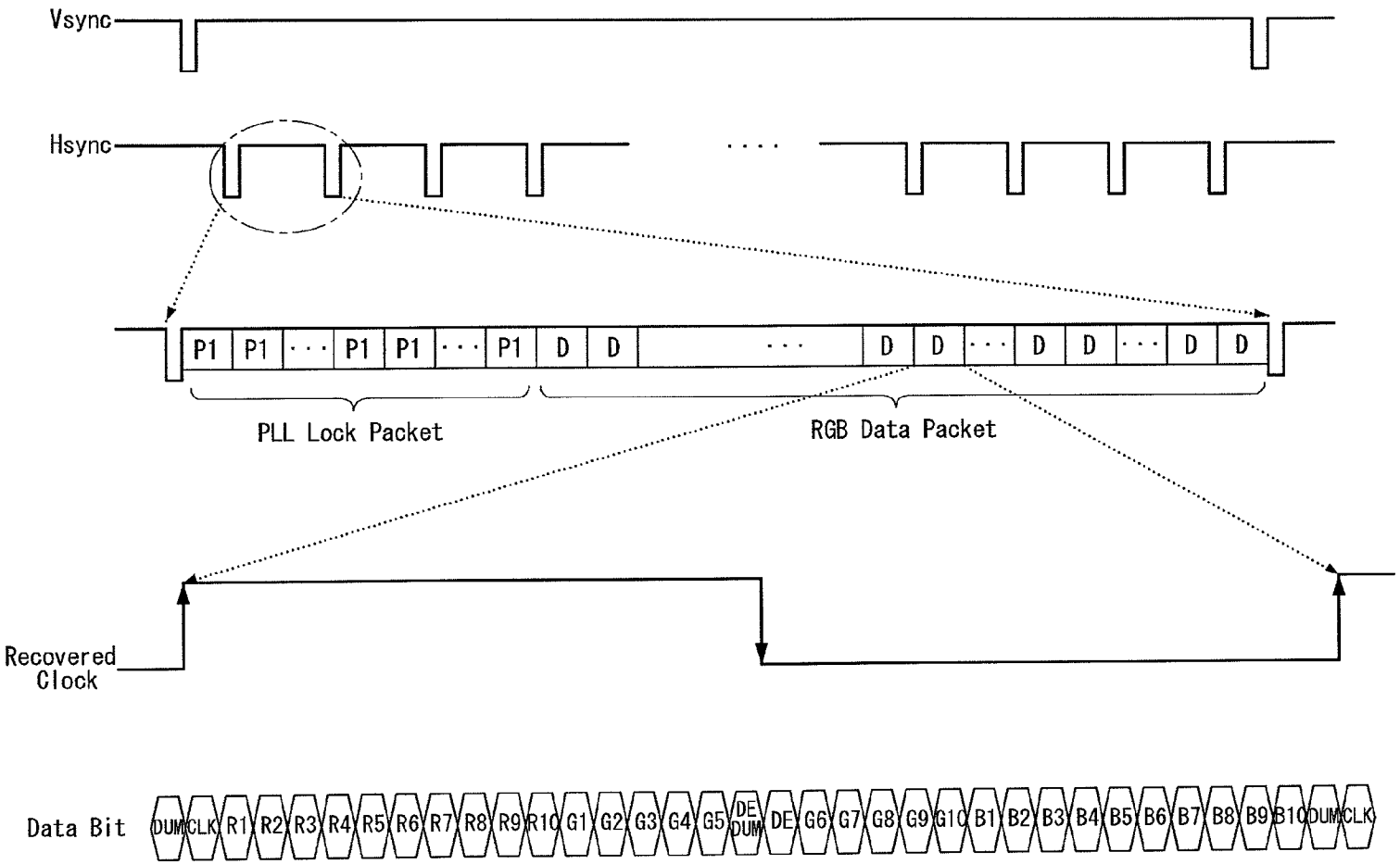
FIGS. 11 to 13 are waveform diagrams illustrating Phase 2 signals generated by a timing controller.
Figure 12:
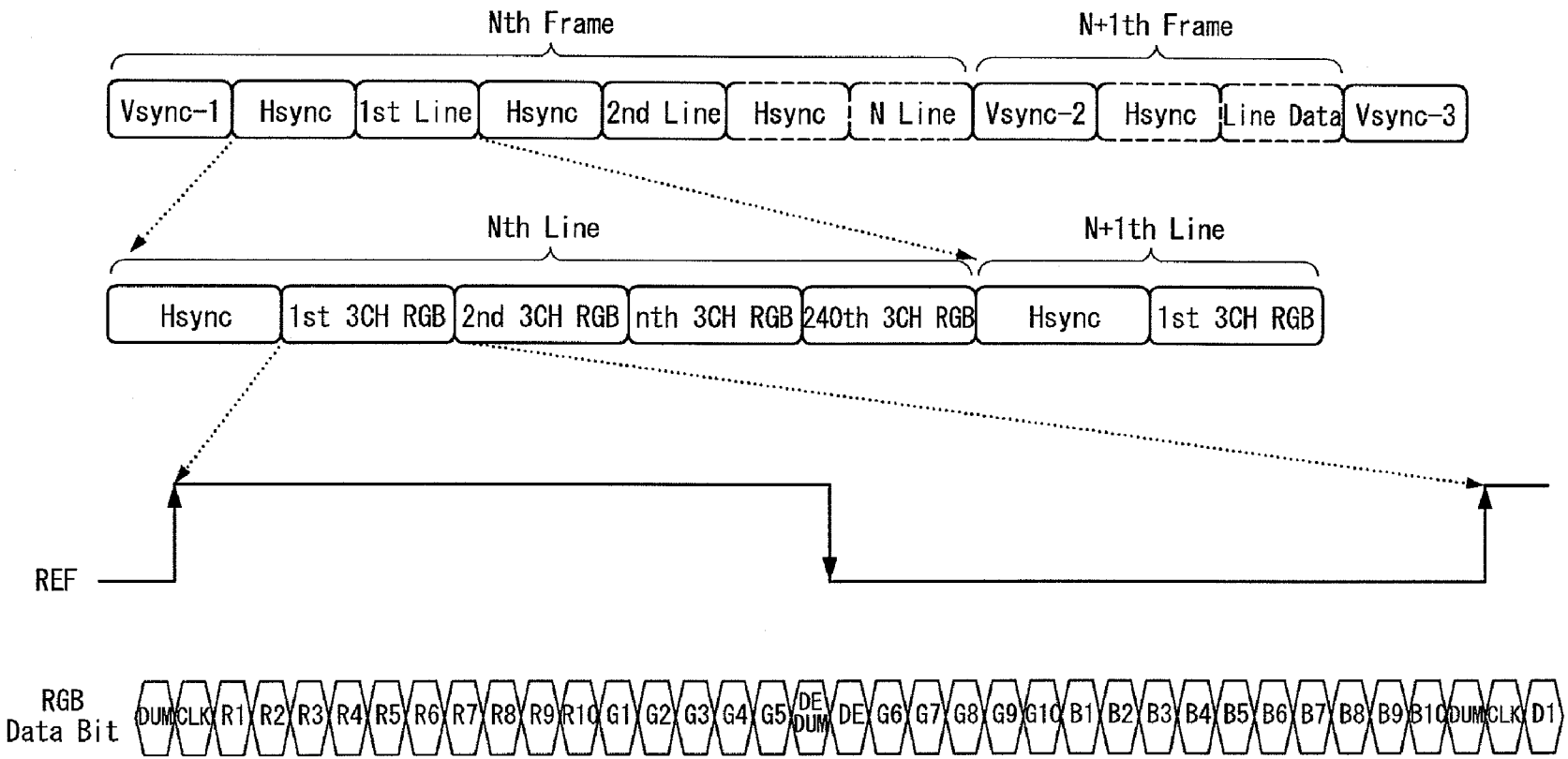
Figure 13:
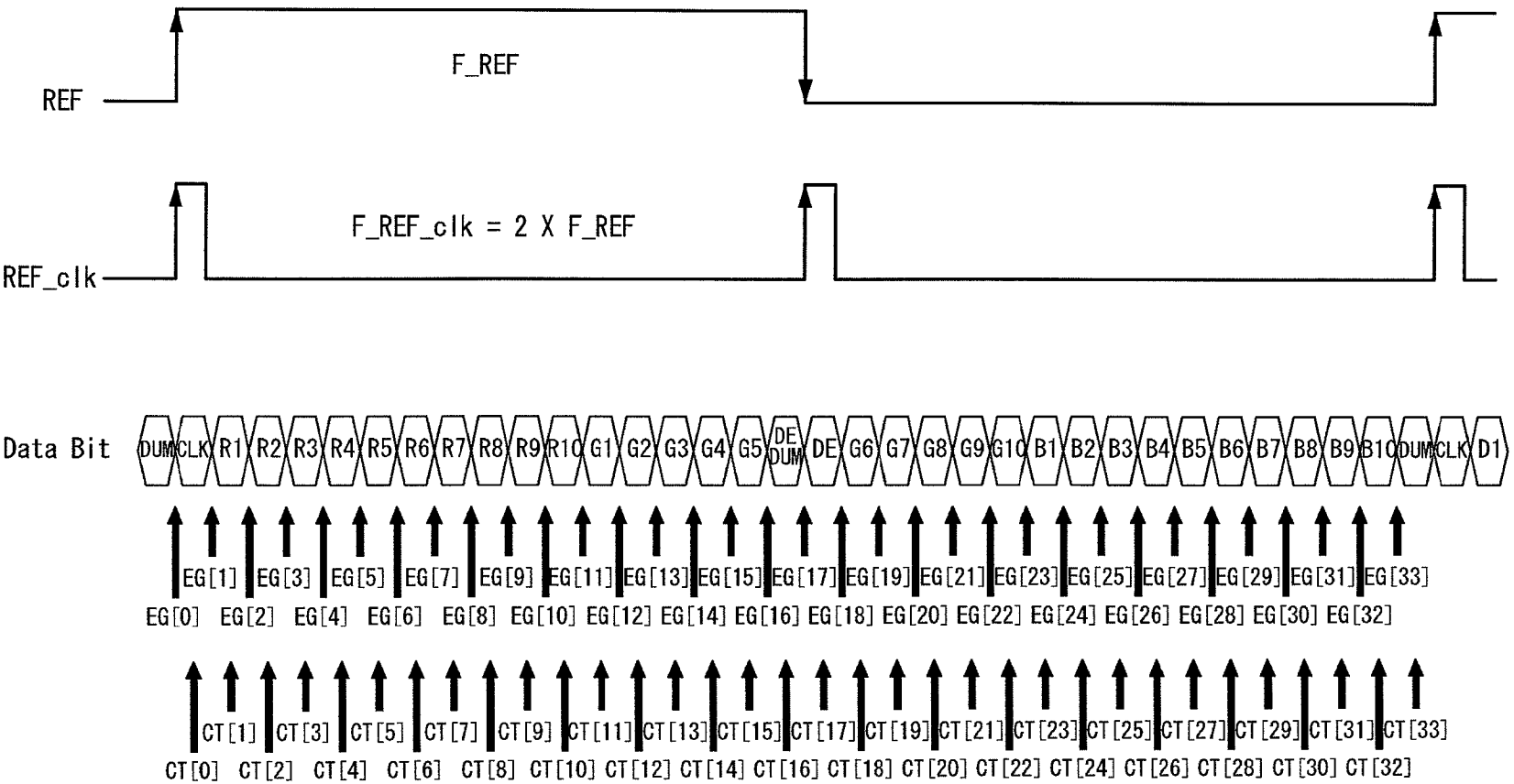

FIGS. 11 to 13 are waveform diagrams illustrating signals generated by the timing controller TCON in Phase 2.

As shown in FIGS. 11 to 13, in Phase 2, the timing controller TCON transfers a plurality of PLL locking data packets and a plurality of RGB|data packets to each of the source drive ICs SDIC#1 to SDIC#8 through the pair of data bus lines DATA&CLK. The PLL locking data packets are assigned during a blanking period in 1 cycle of the horizontal sync signal Hsync, and the RGB data packets to be displayed on 1 line of the liquid crystal display are assigned during a data enable period in 1 cycle of the horizontal sync signal Hsync. The clock separation and data sampling unit 21 restores a clock of the PLL locking data packet to a reference clock and compares the reference clock with an output edge clock and to lock an output of the RGB data packet before an input of the RGB data packet. Then, the clock separation and data sampling unit 21 separates the reference clock from the RGB data packet to generate sampling clocks of a high frequency for sampling each of bits of a bit stream of the RGB data. If a bit stream of 1 RGB data packet includes 10-bit RGB data and 4 clock bits, bits of a dummy clock DUM of a low logic level, bits of a clock CLK of a high logic level, bits R1 to R10, bits G1 to G5, bits of a dummy enable clock DE DUM of a low logic level, bits of an internal data enable clock DE of a high logic level, bits G6 to G10, and bits B1 to B10 are sequentially assigned to the 1 RGB data packet in the order named. If the internal data enable clock DE of a high logic level is generated, the clock separation and data sampling unit 21 recognizes that the bit stream of the RGB data packet is input subsequent to the internal data enable clock DE, and thus samples the RGB data bits in conformity with the sampling clock. Because the internal data enable clock DE of a low logic level is generated in a generation period of the preamble signal in Phase 1, it indicates that there is no bit stream of the RGB data subsequent to the internal data enable clock DE.

The clock separator 63 of the clock separation and data sampling unit 21 generates a reference clock REF_clk whose a rising edge is synchronized with the clock CLK and the internal data enable clock DE. Because the reference clock REF_clk is again transitioned in the internal data enable clock DE, a frequency of the reference clock REF_clk in Phase 2 is greater than two times a frequency of the reference clock REF restored in Phase 1. If the frequency of the reference clock REF_clk of the clock separation and data sampling unit 21 increases, an output of the PLL 64 can be further stabilized because the number of stages inside the VCO of the PLL 64 may decrease. More specifically, if the reference clock REF_clk of the PLL 64 transitions in a middle portion of the RGB data packet in the internal data enable clock DE to increase the frequency of the reference clock REF_clk of the PLL 64 by two times, the number of stages inside the VCO of the PLL 64 may decrease to ½. If the internal data enable clock DE does not use the reference clock REF_clk as a transition clock, 34 VCO stages are necessary. On the other hand, if the internal data enable clock DE uses the reference clock REF_clk as a transition clock, 17 VCO stages are necessary. If the number of VCO stages in the PLL 64 increases, an effect of changes in each of a process, a voltage, a temperature PVT is represented by a multiplication of an increase width in the number of VCO stages. The locking of the PLL 64 may be released because of such an external change. Accordingly, the embodiment of the invention uses the internal data enable clock DE in addition to the clock CLK as the transition clock and thus increases the frequency of the reference clock REF_clk of the PLL. Hence, locking reliability of the PLL can be improved.

Figure 14:
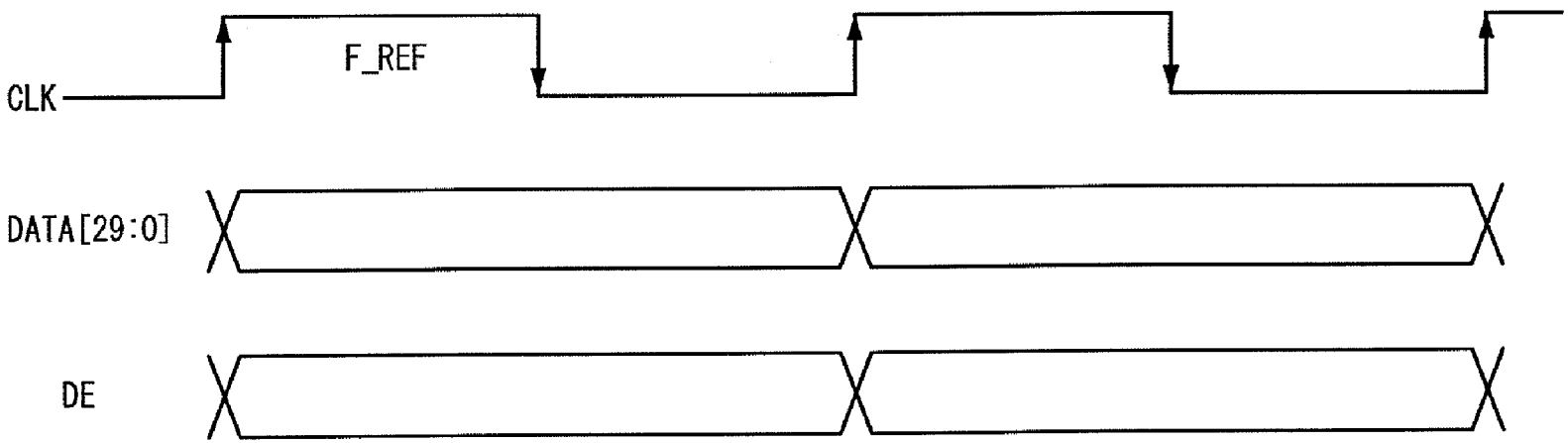
FIG. 14 is a waveform diagram illustrating an output of a clock separation and data sampling unit.

FIG. 14 is a waveform diagram illustrating a clock CLK and an output of the RGB data sampled in response to the clock CLK restored by the clock separation and data sampling unit 21.

The liquid crystal display and the method of driving the same according to the embodiment of the invention are not limited to the RGB data packet illustrated in FIGS. 11 to 13 and may convert a length of the RGB data packet depending on a bit rate of an input image as illustrated in FIGS. 15A to 15D.

Figure 15A:
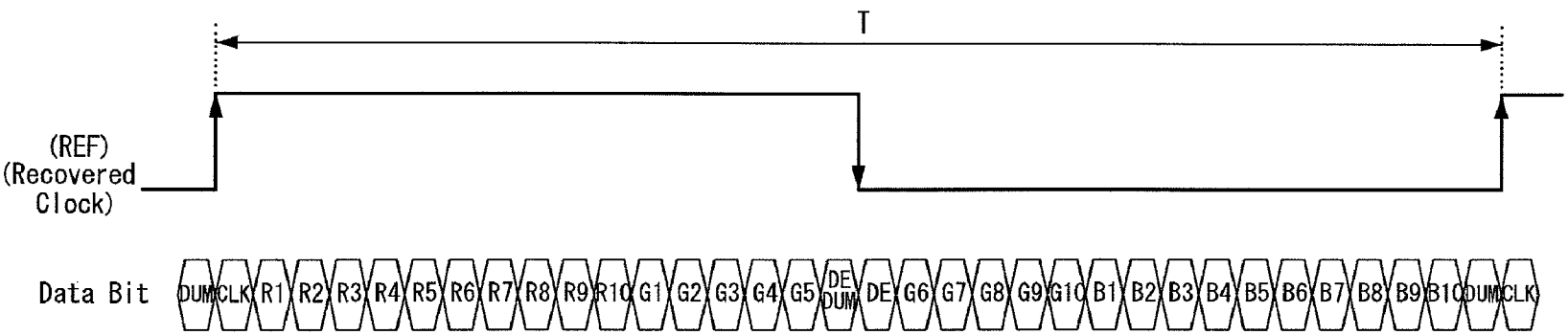
FIGS. 15A to 15D are cross-sectional views illustrating a length of an RGB data packet when a bit rate of the RGB data packet changes.

When each of R data, G data, and B data is 10-bit data, as shown in FIG. 15A, the timing controller TCON generates 1 RGB data packet as a bit stream including DUM, CLK, R1 to R10, G1 to G5, DE DUM, DE, G6 to G10, and B1 to B10 for T hours. In Phase 2, the clock separation and data sampling unit 21 of each of the source drive ICs SDIC#1 to SDIC#8 generates 34 edge clocks and 34 center clocks from the 1 RGB data packet received from the timing controller TCON and samples the RGB data bits in conformity with the center clocks. Then, the clock separation and data sampling unit 21 deserializes the RGB data to output parallel RGB data.

Figure 15B:
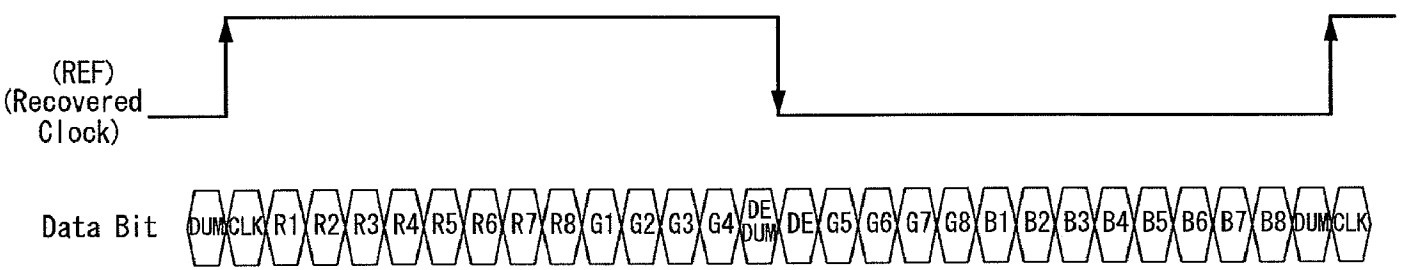

When each of R data, G data, and B data is 8-bit data, as shown in FIG. 15B, the timing controller TCON generates 1 RGB data packet as a bit stream including DUM, CLK, R1 to R8, G1 to G4, DE DUM, DE, G5 to G8, and B1 to B8 for T×(28/34) hours. In Phase 2, the clock separation and data sampling unit 21 of each of the source drive ICs SDIC#1 to SDIC#8 generates 28 edge clocks and 28 center clocks from the 1 RGB data packet received from the timing controller TCON and samples the RGB data bits in conformity with the center clocks. Then, the clock separation and data sampling unit 21 deserializes the RGB data to output parallel RGB data.

Figure 15C:
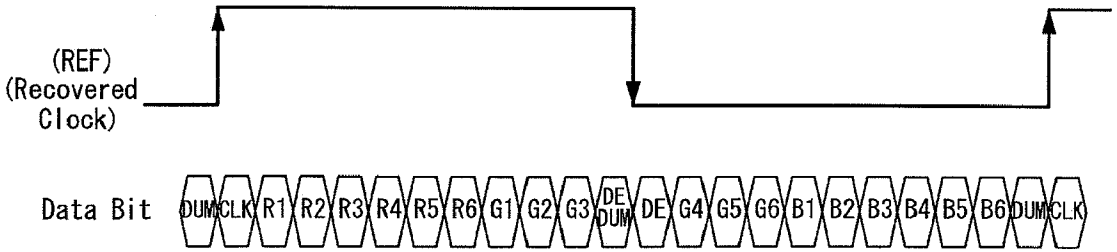

When each of R data, G data, and B data is 6-bit data, as shown in FIG. 15C, the timing controller TCON generates 1 RGB data packet as a bit stream including DUM, CLK, R1 to R6, G1 to G3, DE DUM, DE, G4 to G6, and B1 to B6 for T×(22/34) hours. In Phase 2, the clock separation and data sampling unit 21 of each of the source drive ICs SDIC#1 to SDIC#8 generates 22 edge clocks and 22 center clocks from the 1 RGB data packet received from the timing controller TCON and samples the RGB data bits in conformity with the center clocks. Then, the clock separation and data sampling unit 21 deserializes the RGB data to output parallel RGB data.

Figure 15D:
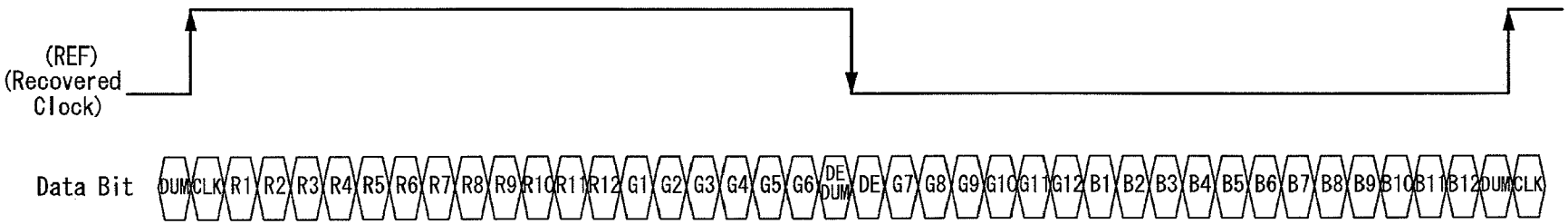

When each of R data, G data, and B data is 12-bit data, as shown in FIG. 15D, the timing controller TCON generates 1 RGB data packet as a bit stream including DUM, CLK, R1 to R12, G1 to G6, DE DUM, DE, G7 to G12, and B1 to B12 for T×(40/34) hours. In Phase 2, the clock separation and data sampling unit 21 of each of the source drive ICs SDIC#1 to SDIC#8 generates 40 edge clocks and 40 center clocks from the 1 RGB data packet received from the timing controller TCON and samples the RGB data bits in conformity with the center clocks. Then, the clock separation and data sampling unit 21 deserializes the RGB data to output parallel RGB data.

The timing controller TCON decides a bit rate of input data and may automatically convert a length of 1 RGB data packet in Phase 2 as shown in FIGS. 15A to 15D.

As described above, in the liquid crystal display and the method of driving the same according to the embodiment of the invention, because a clock generating circuit for data sampling is embedded inside each of the source drive ICs, the number of data transfer lines required between the timing controller and the source drive ICs can be reduced. Furthermore, in the liquid crystal display and the method of driving the same according to the embodiment of the invention, the control lines are connected between the timing controller and the source drive ICs, and the timing controller transfers the chip identification code and the control data to the source drive ICs through the control lines. Accordingly, the source drive ICs can be individually controlled and thus can be independently debugged.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display comprising:

a timing controller;

N source drive integrated circuits (ICs), where N is an integer equal to or greater than 2;

N pairs of data bus lines, each of which connects the timing controller to each of the N source drive ICs in a point-to-point manner;

a lock check line that connects a first source drive IC of the N source drive ICs to the timing controller and cascade-connects the N source drive ICs to one another; and a feedback lock check line that connects a last source drive IC of the N source drive ICs to the timing controller, wherein the timing controller serially transfers a preamble signal, in which a plurality of bits having a high logic level are successively arranged and then a plurality of bits having a low logic level are successively arranged, to each of the N source drive ICs through each of the N pairs of data bus lines, transfers a lock signal indicating that a phase of an internal clock pulse output from each of the N source drive ICs is locked to the first source drive IC through the lock check line, and receives a feedback signal of the lock signal from the last source drive IC through the feedback lock check line.

2. The liquid crystal display of claim 1, wherein after the timing controller receives the feedback signal of the lock signal, the timing controller serially transfers each of RGB data packets including RGB data bits, clock bits, and internal data enable clock bits to each of the N source drive ICs through each of the N pairs of data bus lines.

3. The liquid crystal display of claim 2, wherein each of the N source drive ICs restores a reference clock from the preamble signal to output the reference clock and an internal clock pulse, which has a phase that is locked, wherein each of the N source drive ICs restores the clock bits of the RGB data packet to the reference clock for data sampling to sample the RGB data bits.

4. The liquid crystal display of claim 3, wherein each of the N source drive ICs deserializes the sampled data to output parallel data and then converts the parallel data into an analog data voltage to supply the analog data voltage to data lines of a liquid crystal display panel.

5. The liquid crystal display of claim 4, wherein each of the N source drive ICs includes a phase locked circuit that locks a phase of the internal clock pulse based on the reference clock and outputs the internal clock pulse, which has the phase that is locked.

6. The liquid crystal display of claim 5, wherein the phase locked circuit locks a phase of the reference clock and the phase of the internal clock pulse and then transitions the reference clock depending on the clock bits and the internal data enable clock bits, wherein the phase locked circuit compares the phase of the reference clock with the phase of the internal clock pulse to lock the phase of the internal clock pulse based on the phase of the reference clock.

7. The liquid crystal display of claim 6, wherein the timing controller serially transfers a plurality of locking data packets for locking the phases of the internal clock pulses prior to the RGB data packet to the N source drive ICs through the N pairs of data bus lines, wherein each of the N source drive ICs restores the locking data packet to the reference clock to lock the phase of the internal clock pulse.

8. The liquid crystal display of claim 7, wherein after the timing controller serially transfers each of the plurality of locking data packets to each of the N source drive ICs through each of the N pairs of data bus lines during a blanking period of 1 horizontal period, the timing controller serially transfers each of the RGB data packets to each of the N source drive ICs through each of the N pairs of data bus lines during a data enable period of the 1 horizontal period.

9. The liquid crystal display of claim 6, wherein the phase locked circuit includes one of a phase locked loop (PLL) and a delay locked loop (DLL).

10. The liquid crystal display of claim 1, further comprising a pair of control lines connecting in parallel the timing controller to the N source drive ICs.

11. The liquid crystal display of claim 10, wherein the timing controller transfers a control signal received from the outside to the N source drive ICs through the pair of control lines, wherein the control signal includes a chip identification code for indentifying each of the N source drive ICs and control data for controlling functions of each of the N source drive ICs.

12. A method of driving a liquid crystal display including a timing controller and N source drive integrated circuits (ICs), where N is an integer equal to or greater than 2, the method comprising:

generating a preamble signal, in which a plurality of bits having a high logic level are successively arranged and then a plurality of bits having a low logic level are successively arranged, from the timing controller;

serially transferring the preamble signal to each of the N source drive ICs through each of N pairs of data bus lines connecting the timing controller to the N source drive ICs in a point-to-point manner;

generating a lock signal indicating that a phase of an internal clock pulse output from each of the N source drive ICs is locked from the timing controller;

transferring the lock signal to a first source drive IC of the N source drive ICs through a lock check line that connects the first source drive IC to the timing controller and cascade-connects the N source drive ICs to one another;

generating a feedback signal of the lock signal from a last source drive IC of the N source drive ICs; and transferring the feedback signal of the lock signal to the timing controller through a feedback lock check line connecting the last source drive IC to the timing controller.

13. The method of claim 12, further comprising:

after transferring the feedback signal of the lock signal to the timing controller, generating RGB data packets each including RGB data bits, clock bits, and internal data enable clock bits from the timing controller; and serially transferring each of the RGB data packets to each of the N source drive ICs through each of the N pairs of data bus lines.

14. The method of claim 13, further comprising:

restoring a reference clock from the preamble signal inside each of the N source drive ICs to generate the reference clock and an internal clock pulse, which has a phase that is locked; and restoring the clock bits of the RGB data packet to the reference clock for data sampling inside each of the N source drive ICs to sample the RGB data bits.

15. The method of claim 14, further comprising:

deserializing the sampled data to output parallel data inside each of the N source drive ICs;

converting the parallel data into an analog data voltage inside each of the N source drive ICs; and supplying the analog data voltage to data lines of a liquid crystal display panel.

16. The method of claim 14, further comprising:

locking the phase of the reference clock and the phase of the internal clock pulse by a phase locked circuit included in each of the N source drive ICs and then transitioning the reference clock depending on the clock bits and the internal data enable clock bits; and comparing the phase of the reference clock with the phase of the internal data enable clock by the phase locked circuit to lock the phase of the internal data enable clock based on the phase of the reference clock.

17. The method of claim 16, wherein the phase locked circuit includes one of a phase locked loop (PLL) and a delay locked loop (DLL).

18. The method of claim 14, further comprising:

generating a plurality of locking data packets for locking the phases of the internal clock pulses from the timing controller prior to the RGB data packet;

serially transferring the plurality of locking data packets to each of the N source drive ICs through each of the N pairs of data bus lines; and restoring the locking data packet to the reference clock inside each of the N source drive ICs to lock the phase of the internal clock pulse.

19. The method of claim 18, wherein each of the plurality of locking data packets is serially transferred to each of the N source drive ICs through each of the N pairs of data bus lines during a blanking period of 1 horizontal period, wherein each of the RGB data packets is serially transferred to each of the N source drive ICs through each of the N pairs of data bus lines.

20. The method of claim 12, further comprising:

transferring a control signal received from the outside to the N source drive ICs through a pair of control lines connecting in parallel the timing controller to the N source drive ICs, wherein the control signal includes a chip identification code for indentifying each of the N source drive ICs and control data for controlling functions of each of the N source drive ICs.

* * * * *